US005395095A

United States Patent [19]

Marino et al.

[11] Patent Number: 5,395,095

[45] Date of Patent: Mar. 7, 1995

[54] COMBINED MACHINE FOR OPENING AND PLUGGING A TAPHOLE IN A SHAFT FURNACE

[75] Inventors: Pietro Marino; Geraldo J. A. Costa, both of Belo Horizonte; Luiz F. Evangelista, Contagem; Jean Monai, Belo Horizonte, all of Brazil

[73] Assignee: Paul Wurth S.A., Luxembourg, Luxembourg

[21] Appl. No.: 168,781

[22] Filed: Dec. 16, 1993

[30] Foreign Application Priority Data

Dec. 16, 1992 [LU] Luxembourg ..... 88023

[51] Int. Cl.[6] ..... C21C 5/48

[52] U.S. Cl. ..... 266/273; 266/271

[58] Field of Search ..... 266/271, 272, 273, 45

[56] References Cited

U.S. PATENT DOCUMENTS

| | | | |
|---|---|---|---|
| 3,549,141 | 12/1970 | Zimmermann et al. | 266/273 |
| 3,667,748 | 6/1972 | Dienenthal et al. | 266/273 |
| 4,909,487 | 3/1990 | Schneider | 266/273 |
| 5,225,145 | 7/1993 | Winch | 266/273 |
| 5,246,208 | 9/1993 | Mailliet et al. | 266/173 |

*Primary Examiner*—Scott Kastler

*Attorney, Agent, or Firm*—Fishman, Dionne & Cantor

[57] ABSTRACT

A combined machine for opening a taphole in a shaft furnace and for plugging the taphole with a plugging mass is presented. The machine comprises a mount, a suspension structure for the mount, drive means on the mount and a plugging device. The plugging device portion of the machine comprises a plugging chamber, plugging snout and a piston for expelling the plugging mass. For the plugging operation, the plugging device is supported on the mount in the extension of the axis of the taphole and the expulsion piston is coupled to the drive means already present on the mount for opening the taphole with a piercing rod or a drill bit.

10 Claims, 5 Drawing Sheets

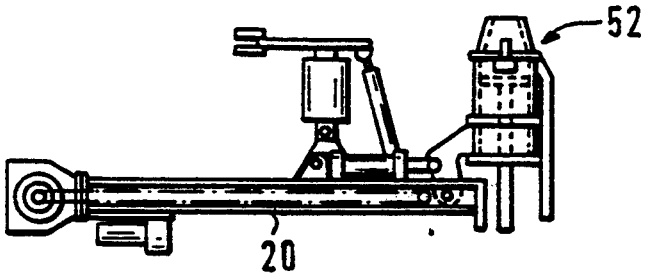
Fig. 5.1
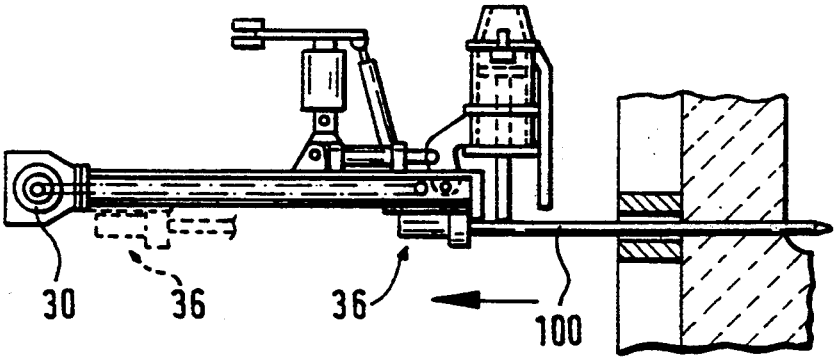
Fig. 5.2
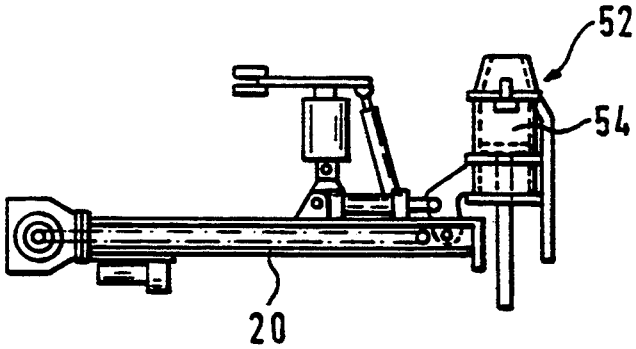
Fig. 5.3

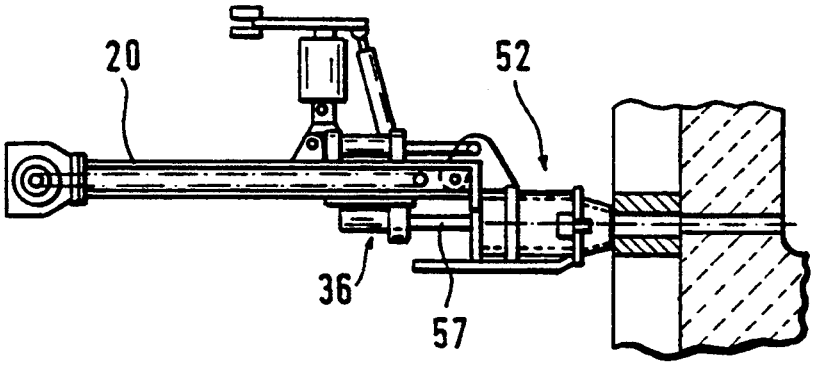
Fig. 5.4
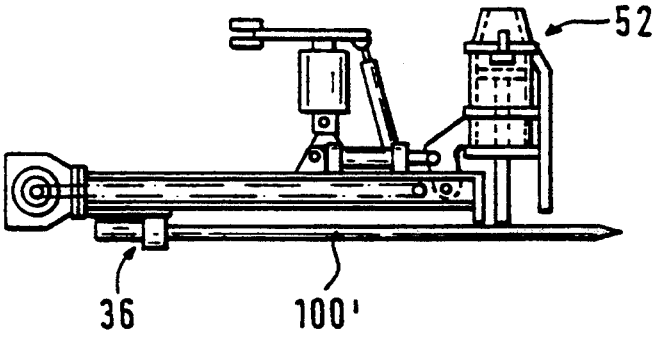
Fig. 5.5
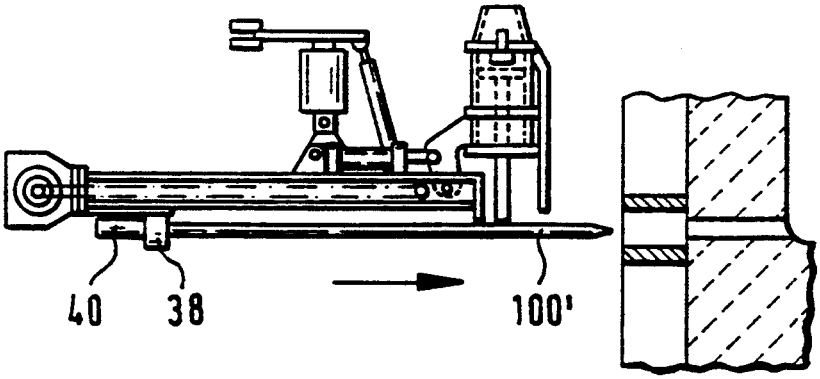
Fig. 5.6

COMBINED MACHINE FOR OPENING AND PLUGGING A TAPHOLE IN A SHAFT FURNACE

BACKGROUND OF THE INVENTION

The present invention relates generally to a new and improved machine for opening a taphole in a shaft furnace and for plugging the taphole. More particularly, this invention relates to a combined machine, that can open a taphole in a shaft furnace, plug up the taphole by injecting a plugging mass and then drive a piercing rod into the plugged taphole prior to the plugging mass being fully hardened.

Various machines have been provided for opening a taphole in a wall of a shaft furnace in accordance with a process known as the lost rod method. In this process,- the taphole is plugged or closed with a plugging mass, a metal rod is driven into the plugging mass before it has completely hardened and, at the desired moment, the metal rod (or piercing rod) is removed to open the taphole. Such machines comprise a mount for supporting a piercing rod, a suspension structure for the mount designed to displace the mount from a parked position away from the taphole into an operating position in which the mount is located in the extension of the axis of the taphole. Drive means are installed on the mount to develop a pulling force or pushing force, respectively as required, parallel to the longitudinal axis of the mount. In this case, a coupling device which can be displaced on the mount is connected to the drive means in order to transmit the pushing force to a piercing rod supported on the mount in order to drive it into the plugging mass previously injected into the taphole, or to transmit the pulling force to a piercing rod sealed in the hardened plugging mass to remove this rod from the taphole. Various operating principles for such machines are, for example, described in Patent Specifications EP-0,379,018 (corresponding to U.S. Pat. No. 5,192,489), LU-87,915, LU-88,029 (corresponding to U.S. application Ser. No. 968,984 filed Oct. 30, 1992), LU-88,058 (corresponding to U.S. application Ser. No. 008,128 filed Jan. 22, 1993), LU-88,059 (corresponding to PCT application WO 93/15 231), LU-88,060 (corresponding to U.S. application Ser. No. 008,129 filed Jan. 22, 1993) and LU-88,135 (corresponding to U.S. application Ser. No. 080,145 filed Jun. 17, 1993), all of the contents of the foregoing patents and applications being incorporated herein by reference. It should be pointed out that, on all these machines, there also exists the possibility of drilling the taphole using a conventional drill bit driven by a rotary work device which can also be displaced on the mount by the aforementioned drive means.

Besides a boring machine, it is essential to have available a plugging machine in order to be able to inject the plugging mass into the taphole. Such a plugging machine comprises, in a known manner, its own suspension structure for displacing a plugging device from a parked position away from the taphole into a plugging position in which it is aligned with the axis of the taphole and means to force the plugging device firmly against the wall of the furnace during the plugging operation. The plugging device of a plugging machine comprises a plugging chamber to receive the plugging mass, a plugging snout, a piston to expel the plugging mass, fitted in the plugging chamber, and a powerful hydraulic jack arranged in the axis of the expulsion piston to displace the expulsion piston axially in the plugging chamber and thus inject the plugging mass under pressure through the plugging snout into the taphole.

The presence of two machines, namely a boring machine and a plugging machine constitutes two major problems. The overall size of the two machines fills up the work area around the shaft furnace and makes it difficult to operate efficiently and with safety. In addition, the cost of two separate machines is high and, particularly, the investment costs are especially severe for small shaft furnaces.

A combined machine which can be used both for opening the taphole in a shaft furnace and for plugging the taphole with a plugging mass is therefore needed. This would be both economical, space saving and increase the safety of the work place.

SUMMARY OF THE INVENTION

The above-discussed and other drawbacks and deficiencies of the prior art are overcome or alleviated by the combined machine for opening and plugging a taphole in a shaft furnace of the present invention. In accordance with the present invention this machine comprises:

(1) a mount for supporting a piercing rod or a drill bit;

(2) a suspension structure for the mount designed to displace the mount from a parked position away from the taphole into an operating position in which the mount is located in the extension of the axis of the taphole;

(3) drive means installed on the mount to develop a pulling force or pushing force, respectively, parallel to the longitudinal axis of the mount, for axially displacing the piercing rod or the drill bit along the mount;

(4) a plugging device comprising a plugging chamber to receive the plugging mass, a plugging snout mounted at the front of the plugging chamber, a piston for expelling the plugging mass, which is fitted and can be displaced in the plugging chamber;

(5) a support integral with the mount to support the aforementioned plugging device in a plugging position on the mount; and (6) coupling means for coupling the aforementioned expulsion piston to the aforementioned drive means.

It will be appreciated that the combined machine that is provided by the present invention requires only one suspension structure for the mount. The plugging device is itself supported on the mount. Moreover, the plugging device does not include separate drive means. These two important features of this invention appreciably reduce the cost of such a machine, compared with the cumulative cost of a separate plugging machine and a separate boring machine.

From the point of view of floor space, the proposed combined machine is scarcely larger than a conventional boring machine. Consequently, from the point of view of floor space, the area formerly required for storing the plugging machine is saved.

It will be noted that, if the plugging device, supported in the folded position on the mount, does not impede the operation of introducing and removing the piercing rod or, respectively, drilling with a conventional drill bit, which is quite feasible, it can remain in its folded position. If this is not the case, the plugging device must, for example, be temporarily removed from its support on the mount in order to permit the use of the machine as a boring machine.

In the preferred embodiment, the support (integral with the mount) makes it possible to support the plugging device, in the plugging position, exactly in the imaginary extension of the taphole when the mount is in operating position. The support preferably comprises pivoting means designed to pivot the plugging device away from the plugging position into a non-operating position where the plugging device is located away from the imaginary extension of the taphole when the mount is in the operating position. This design of the machine has the advantage that the positioning and the orientation of the mount in front of the taphole are the same for the boring operation and for the plugging operation, which renders superfluous any readjustment of the suspension structure of the mount between the two operations.

It will usually be advantageous to pivot the plugging device upwards through an angle of 90°. However, this does not rule out the fact that, for certain uses, a person skilled in the art will prefer to pivot the plugging device into a lateral position with respect to the mount. The plugging device is pivoted preferably with the aid of a hydraulic jack which is connected between the plugging chamber and the mount.

For optimum transmission of the forces between the drive means and the expulsion piston, it will be preferable to provide a piston rod which is integral with the expulsion piston and extends outside the plugging chamber on the side opposite the plugging snout and which is, moreover, substantially parallel to the longitudinal axis of the mount.

The combined machine may include separate coupling means for coupling the expulsion piston or the piston rod, respectively, to the drive means when the plugging device is supported in the plugging position. Usually, however, it is advantageous to use a coupling device already present on the mount and which is used to transmit to the pushing or pulling force, developed by the drive means, to a piercing rod. Such coupling devices usually comprise a clamp, for clutching one end of the piercing rod so as to transmit a pulling force to it, and a bearing surface for bearing on a front surface of the piercing rod so as to transmit an axial pushing force to the piercing rod. However, there are also systems for coupling by means of screw threads, keys, hooks, etc., which may all be used on the machine of this invention.

It will also be appreciated that the plugging device which can be folded back is equipped with a protective screen arranged below the plugging chamber and extending below the piston rod.

Preferred drive means comprise a rotary hydraulic motor mounted at the rear of the mount and an endless chain mounted axially in the mount. Other drive systems using, for example, linear hydraulic motors, can alternatively be used or have already been used or proposed within the field of boring machines.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES:

FIGS. 5.1, 5.2, 5.3, 5.4, 5.5, and 5.6 diagrammatically show the various stages of opening or plugging the taphole, respectively, using the device of FIG. 1.

DESCRIPTION OF THE PREFERRED EMBODIMENT

Figure 1:
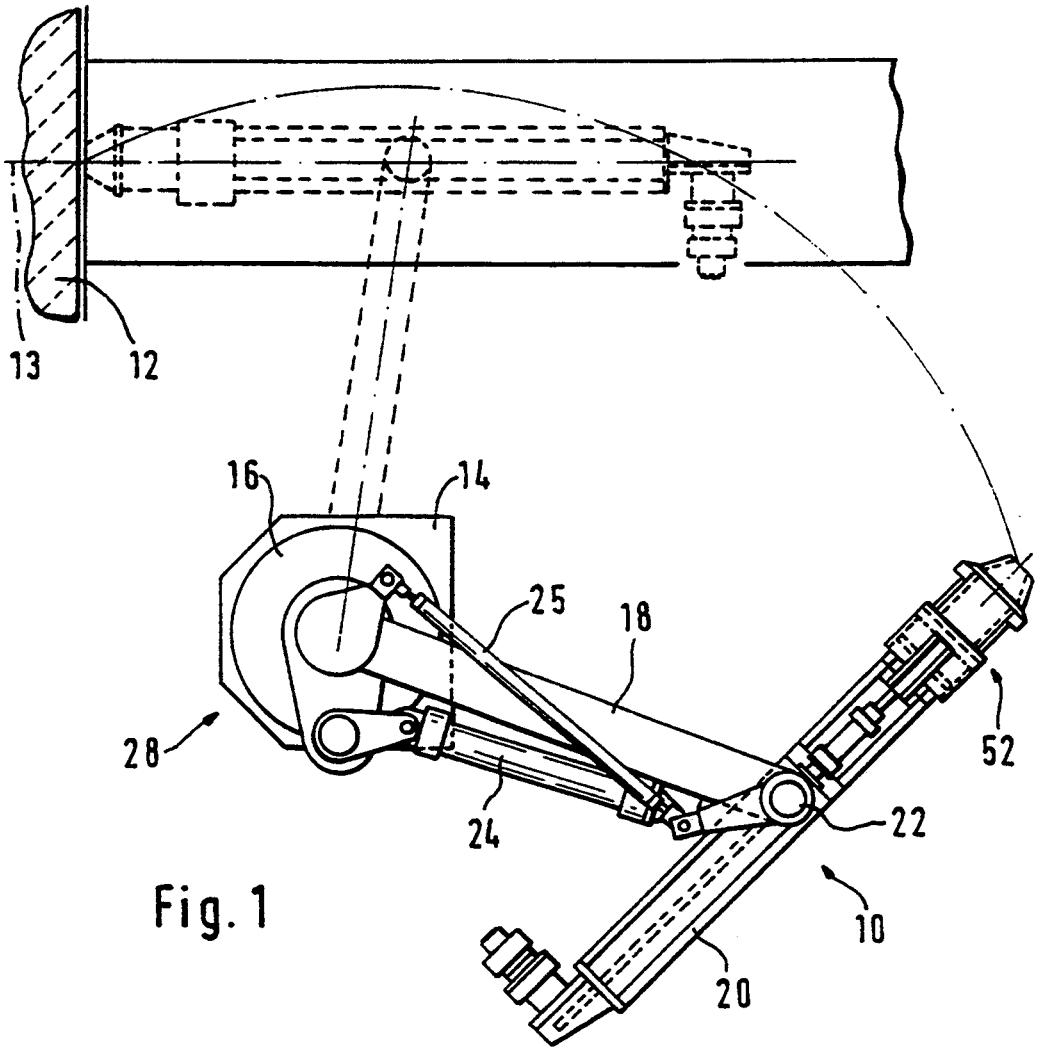
FIG. 1 is a plan view of the overall machine of the present invention with the solid lines represent the machine in the parked position and, the broken lines represent the machine in the operating position in front of the taphole.
Figure 2:
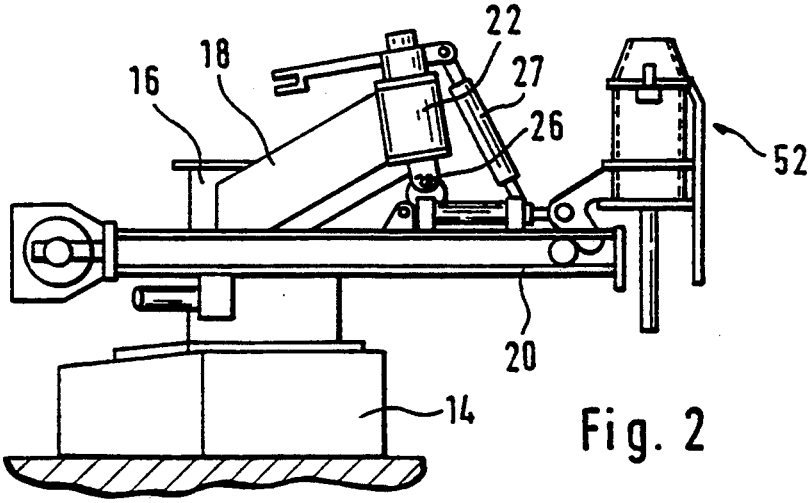
FIG. 2 is a front view of the overall machine of the device of FIG. 1 in the parked position.

FIG. 1 is an overall view of the combined plugging/-boring machine 10 installed in front of a shaft furnace 12 which is shown diagrammatically by a section through its wall. A taphole is represented by its axis, referenced 13. The machine is mounted on a base 14 with the aid of a pedestal 16. A first end of a suspension arm 18 is articulated to this pedestal 16. The other end of this suspension arm 18 supports a mount 20 by means of an articulation 22. A jack 24 is connected between the pedestal and the mount 20 so as to be able to pivot the suspension arm 18 with respect to the pedestal 16. A guide bar 25 connects the mount to the pedestal 16 and, with the jack 24, forms a pseudoparallelogram. It follows that the jack 24 alone is sufficient to pivot the mount 20 away from a parked position, shown in solid lines, and to position it in front of the taphole in an operating position, shown in broken lines. An adjustment in the length of the guide bar 25 makes it possible to modify the final orientation of the mount in the plane of FIG. 1. The inclination of the mount in a vertical plane about a horizontal articulation 26 in the suspension arm 18 may be determined with the aid of an adjusting bar 27 (cf. FIG. 2).

The suspension structure, described above and referenced globally by 28 in FIG. 1, has the advantage of having served satisfactorily in a number of uses on boring and plugging machines. However, it will be appreciated that, in certain cases, it may be more advantageous to choose another type of suspension for the mount 20.

The mount 20 is described with reference to FIG. 3. It is principally a mount of a conventional taphole boring machine which has been modified for implementing the lost-rod process. The mount includes, at its rear end, a rotary hydraulic motor 30 driving one or more endless chains 32 which extend axially in the mount 20. This chain or these chains 32 drive a sliding carriage 34 along the mount 20. A coupling device 36 designed to transmit to a piercing rod 100, either an axial pushing force in order to drive it into the plugging mass, or a pulling force in order to remove piercing rod 100 from the taphole in order to open the taphole, is supported by the carriage 34.

In order to remove the rod from the taphole, this coupling device 36 comprises, for example a clamp 38 with a pair of pneumatically actuated jaws arranged about an axial channel, so as to be able to exert a considerable pulling force on the free end of the piercing rod 100. This clamp 38 could, however, also be replaced by any other coupling enabling the carriage 34 to be coupled to the free end of the piercing rod 100 in order to transmit to it the pulling force necessary for its removal. The end of the piercing rod 100 could thus, for example, be coupled to the coupling device 36 with the aid of a transverse key. A percussion device 40 may, if appropriate, be used to release the piercing rod 100 before it is removed.

In order to be able to drive the piercing rod 100 into the plugging mass previously injected into the taphole, the clamp 38 includes, for example, in the axial channel, a bearing surface which bears on one end of the piercing rod 100 introduced into this channel. As it advances towards the taphole, the carriage 34 thus exerts an axial pushing on this end of the piercing rod 100 and causes the other end to penetrate progressively into the plugging mass. In order to prevent buckling of the piercing rod 100, the piercing rod 100 may, for example, be guided laterally by one or more intermediate guides (not shown), or the percussion device 40 may, for example, be a percussion device which delivers a percussion force in the direction of the taphole. However, provision could also be made in the clamp 38 for a channel for the piercing rod 100 which axially transverses right through the body of the clamp 38. A second pair of jaws, disposed about the channel and oriented in the opposite direction of the first pair of jaws, then makes it possible firmly to clutch the piercing rod 100 so as to communicate to it an axial pushing in the direction of introduction into the taphole. This two-directional clamp can then be used to introduce the piercing rod 100 into the plugging mass in a reciprocal movement of the carriage 34 at the front of the mount 20. The stroke of this reciprocal movement is determined so as to be smaller than the critical buckling length of the piercing rod 100, which eliminates any risk of the rod buckling during its introduction.

At the front of the mount 20, the piercing rod 100 is supported in a known manner by a bearing piece, for example, a sliding bearing piece 42. It remains to be pointed out that it is also possible to mount a rotary drive device (not shown) on the mount 20 in order to drill a taphole with a conventional drill bit.

At the front of the mount 20, a plugging device 52 is supported with the aid of a bent arm 50. This plugging device 52 includes a plugging chamber 54, to receive the plugging mass, and a plugging snout 56 via which the plugging mass can be ejected. A piston for expelling the plugging mass is fitted and can be displaced in the chamber 54. The piston rod 57 is extended axially outside the chamber 54.

Figure 3:
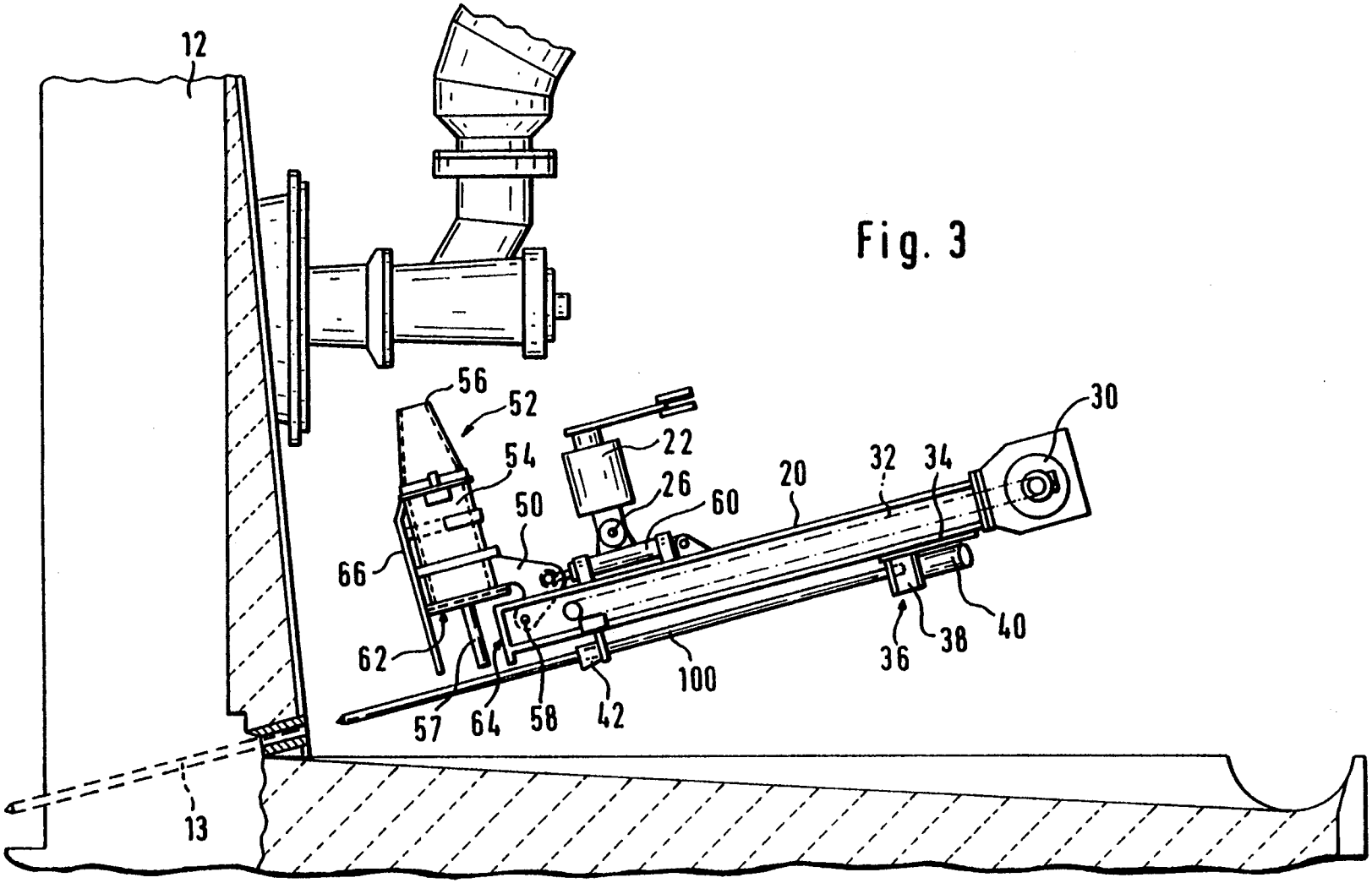
FIG. 3 shows a front view of the mount of the device of FIG. 1 in the operating position in front of the taphole, prepared to introduce a piercing rod into the plugging mass previously injected into the taphole.

FIG. 3 shows that, for the operations of introduction and removal of a piercing rod 100, as well as for any boring operation using a drill bit, the aforementioned plugging device can be pivoted into a non-operating position about an articulation 58. In this position, the plugging device 52 is located entirely away from the extension of the axis of the taphole 13, when the mount is aligned with the axis as the taphole 13 for the introduction or the removal of a piercing rod, or for the drilling of a taphole with a conventional drill bit. In the FIGUREs, the axis of articulation 58 is horizontal and perpendicular to the axis of the mount. The plugging device 52 has, in the non-operating position, the plugging snout 56 pointing vertically upwards. It is, however, obvious that a lateral folding back of the plugging device 52 is also feasible. A jack 60, connected at one of its ends to the mount 20 and with the other end to the bent arm 50, makes it possible to control this folding-back hydraulically.

Figure 4:
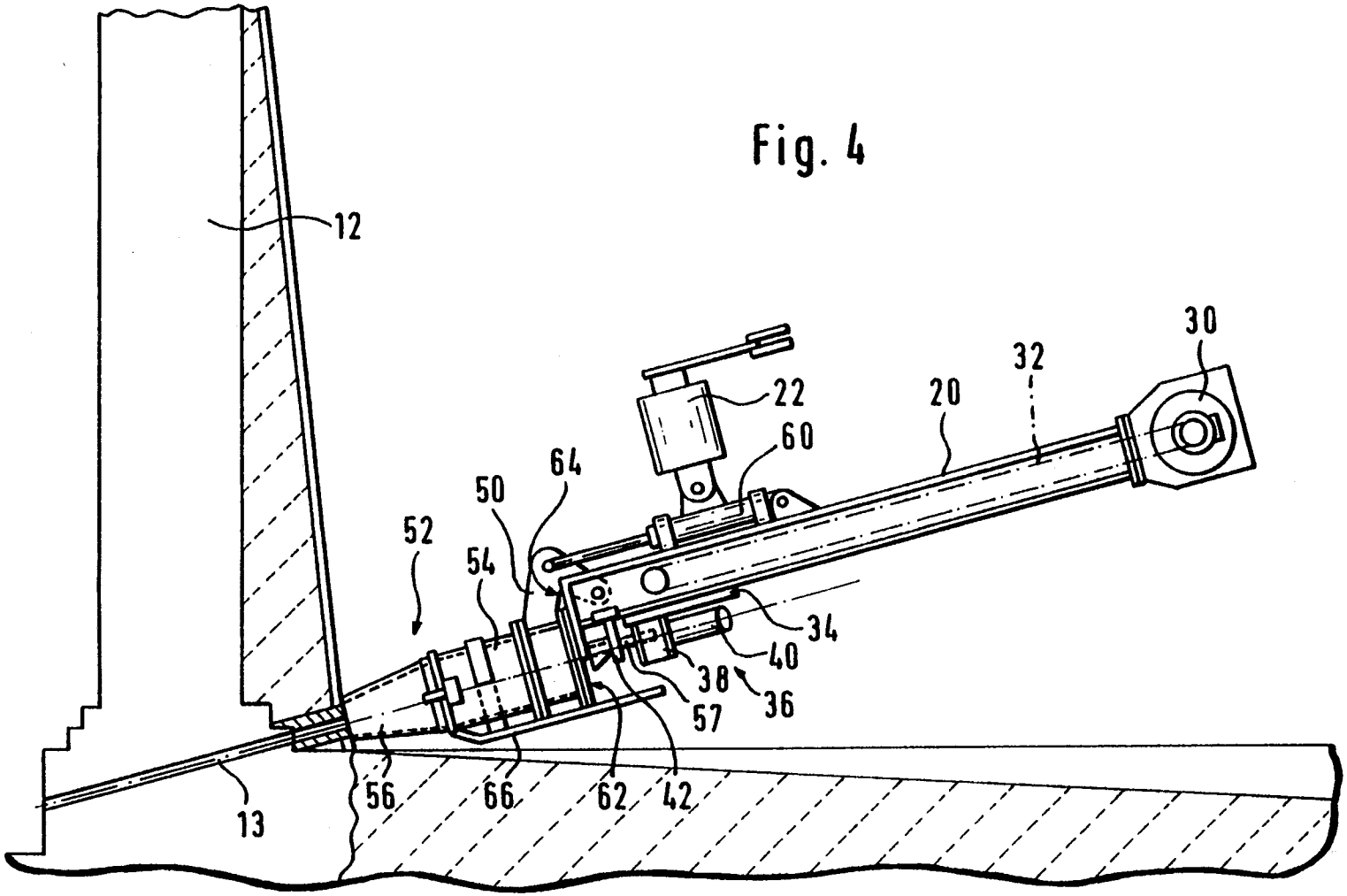
FIG. 4 show a front view of the mount of the device of FIG. 1 in the operating position in front of the taphole during plugging of the taphole.

In FIG. 4, the plugging device is shown in the plugging position, the mount still being aligned with the axis of the taphole. The jack 60 pushes the plugging chamber 54 with its rear surface 62 against a bearing surface 64 provided at the front of the mount 20 so that the plugging device is immobilized in the axis of the mount. In this plugging position of the plugging device 52, the jack 24 of the suspension structure 28 makes it possible to push the plugging snout 56 firmly against the wall of the furnace 12 in the extension of the axis of the taphole 13, when the mount 20 is located in the operating position.

In accordance with the present invention, the plugging device 52 does not itself have drive means for the piston for expelling the plugging mass. This feature makes it possible to reduce the structural length and the weight of the plugging device 52. Without this feature, it would, moreover, be extremely difficult to support the plugging device 52 on the mount 20. In fact, the overall length of the plugging device 52 with drive means would become too great, and the mount 20 and its suspension structure 28 would have to be excessively reinforced in order to support the additional load.

It will consequently be advantageous for the expulsion piston of the plugging device 52 to be in accordance with the present invention, driven by the drive device of the carriage 34 (namely, in the present case, by the rotary hydraulic motor 30 via the endless chain or chains 32).

The piston rod 57 is preferably coupled to the chain 32 through the coupling device 36 already present on the mount and which, as has been seen above, is normally used for the introduction of a piercing rod into the taphole and for its forcible removal. To this end, the rear end of the piston rod 57 must have substantially the same diameter as the piston rod and be aligned in the extension of the axis of the channel of the clamp 38. In this manner, the clamp 38 can bear on the rear end of the piston rod 57 in order to push the expulsion piston into the plugging chamber 54 in the direction of the plugging snout 56. In order to withdraw the piston rearwardly again, so as to permit the filling of the plugging chamber 54, the clamp 38 clutches the rear end of the piston rod 57 and the carriage 34 is withdrawn rearwardly. If, instead of the clamp 38, a system which uses a key to couple the coupling device 36 to the rear end of the piercing rod 100 is used for the removal of the piercing rod 100, it is naturally necessary for the rear end of the piston rod 57 to be designed in the same manner as the rear end of the piercing rod 100 in order to interact with this key. If a two-directional clamp is employed, it suffices for the rear end of the piston rod 57 to be aligned in the extension of the axis of the channel of the clamp and to be capable of engaging in the clamp over a sufficient length in order to enable it to be clutched by the two pairs of jaws oriented in the opposite direction.

The reference 66 refers to a protective screen arranged below the plugging chamber and extending below the piston rod 57. It will be noted that this protective screen efficiently protects the piston rod 57 and the front of the mount 20 against any splashes projected when the taphole is opened.

It will further be noted that replacement of the rotary hydraulic motor 30 and the endless chain 32 by another drive system, for example one or more linear hydraulic motors, which may or may not be equipped with a stroke multiplier, would be in accordance with this invention.

The various stages of opening and plugging the taphole with the proposed machine will be studied with the aid of FIGS. 5.1 to 5.6.

In FIG. 5.1, the mount 20 is in the parked position, and the plugging chamber 52 is folded back upwardly. The mount is brought by its suspension structure 28 into its operating position in the extension of the taphole (cf. FIG. 5.2). The coupling device 36 is coupled to the free end of the piercing rod 100 which emerges from the taphole. The motor 30 withdraws the coupling device 36 towards the rear of the mount 20 and thus frees the taphole by removing the piercing rod 100.

The mount 20 is then brought back into the parked position (cf. FIG. 5.3) and the piercing rod which has been withdrawn from the taphole is removed from the mount 20. The plugging device 52 is then folded back into the horizontal position and the piston rod 57 is withdrawn rearwards by the coupling device 36 in order to permit the filling of the plugging chamber 54. In order to facilitate this filling of the plugging chamber 54 with the plugging mass, the plugging device is preferably folded back into the vertical position.

Next (see FIG. 5.4), the plugging device 52 is again folded back into the horizontal position, the mount 20 is brought back into the operating position and the plugging snout 56 is pressed against the wall of the furnace 12. The coupling device 36 bears on the piston rod 57 and advances the expulsion piston towards the plugging snout, thus injecting the plugging mass into the taphole.

In the following stage (see FIG. 5.5), the emptied plugging device 52 is again folded back upwards and a new piercing rod 100' is positioned on the mount 20.

FIG. 5.6 diagrammatically shows a method of introducing this piercing rod 100' into the plugging mass during hardening. The clamp 38 bears on the end of the piercing rod 100' and causes the piercing rod to penetrate into the plugging mass. The percussion device 40 is actuated if there is a risk of the rod buckling.

While preferred embodiments have been shown and described, various modifications and substitutes may be made thereto without departing from the spirit and scope of the invention. Accordingly, it is to be understood that the present invention has been described by way of illustrations and not limitation.

What is claimed is:

1. A machine for opening a taphole in a shaft furnace and for plugging said taphole by injecting a plugging mass, comprising:

an oblong mount for supporting a piercing rod or a drill bit;

a suspension structure for displacing the mount from a parked position away from the taphole into an operating position in which said oblong mount in located in the extension of the axis of the taphole;

drive means mounted on the oblong mount so as to be capable of developing a pulling force and a pushing force parallel to the longitudinal axis of the oblong mount;

first coupling means for coupling said drive means to a piercing rod or a drill bit supported on said mount so as to be capable of transmitting said pushing force and said pulling force to said piercing rod or said drill bit;

a plugging device comprising a plugging chamber to receive the plugging mass, a plugging snout mounted at a front of the plugging chamber, an expulsion piston for expelling the plugging mass, which is fitted and can be displaced in the plugging chamber;

a support integral with the mount to support said plugging device in a plugging position on said mount; and second coupling means for coupling said expulsion piston to said drive means.

2. The device of claim 1, wherein the said coupling means comprise:

a piston rod integral with the expulsion piston and extending outside the plugging chamber on the side opposite the plugging snout wherein, in said plugging position, said piston rod is substantially parallel to the longitudinal axis of the mount.

3. The device of claim 2, wherein:

said support, integral with said mount supports said plugging device in said plugging position, in the extension of the taphole when the mount is in said operating position, and wherein said support comprises;

an articulation and pivoting means for pivoting said plugging device away from said plugging position into a non-operating position, in which the plugging device is located away from the extension of the taphole when the mount is in a non-operating position.

4. The device of claim 3 wherein:

said plugging device can be folded back upwards from the said plugging position through an angle of about 90°.

5. The device of claim 4, wherein:

said plugging device includes a protective screen below said plugging chamber and extending below said piston rod.

6. The device of claim 3, wherein:

said pivoting means comprise a hydraulic jack.

7. The device of claim 2, wherein:

said first coupling means includes a coupling device displaceable on said mount and connected to said drive means in order to transmit said pushing force to a piercing rod supported on the mount in order to drive it into a plugging mass previously injected into the taphole, or to transmit said pulling force to a piercing rod sealed in the plugging mass to remove it from the taphole, respectively.

8. The device of claim 7, wherein:

said second coupling means includes said coupling device provided for the introduction and removal of the piercing rod.

9. The device of claim 1, wherein:

said drive means comprise a rotary hydraulic motor mounted at the rear of said mount and at least one endless chain mounted axially in the mount.

10. The device of claim 1, including:

a work device with rotary drive for receiving a drill bit, and means for coupling said work device to said drive means.

* * * * *